US006758205B2

(12) United States Patent
Kronfeld

(10) Patent No.: US 6,758,205 B2
(45) Date of Patent: Jul. 6, 2004

(54) VIBRATION REDUCING DEVICES FOR BOWS

(76) Inventor: Leonid G. Kronfeld, 88 Lucas Dr., Stoughton, MA (US) 02072

( * ) Notice: Subject to any disclaimer, the term of this patent is extended or adjusted under 35 U.S.C. 154(b) by 0 days.

(21) Appl. No.: 09/864,103

(22) Filed: May 23, 2001

(65) Prior Publication Data

US 2001/0045211 A1 Nov. 29, 2001

Related U.S. Application Data

(60) Provisional application No. 60/206,250, filed on May 23, 2000.

(51) Int. Cl.[7] ..... F41B 5/20

(52) U.S. Cl. ..... 124/89

(58) Field of Search ..... 124/89; 16/82, 16/86 R, 86 A; 292/342, 343; D8/402

(56) References Cited

U.S. PATENT DOCUMENTS

| | | | | | |
|---|---|---|---|---|---|
| 2,198,303 | A | * | 4/1940 | Chu | |
| 3,977,714 | A | * | 8/1976 | Trotter | |
| 4,556,042 | A | * | 12/1985 | Izuta | 124/89 |
| 4,633,846 | A | * | 1/1987 | Ipock | |
| 5,362,046 | A | | 11/1994 | Sims | 273/73 |
| 5,595,168 | A | * | 1/1997 | Martin | 124/89 |
| 6,298,842 | B1 | * | 10/2001 | Sims | 124/89 |

* cited by examiner

*Primary Examiner*—John A. Ricci
(74) *Attorney, Agent, or Firm*—Donald T. MacPhail; MacPhail Law Firm

(57) ABSTRACT

Dampener device for archery bows of wedge shape form, with one or more of such devices (10) placed on a bow and dampening a wide range of frequency oscillations, each device made of elastomeric material (or combination of various materials) and having a base portion (12) adhered to the bow and or extension triangular portion (14) suspended from the base.

23 Claims, 2 Drawing Sheets

VIBRATION REDUCING DEVICES FOR BOWS

CROSS REFERENCE TO RELATED APPLICATIONS

This application claims priority of Provisional Application No. 60/206,250, entitled SILENT WAVE—VIBRATION REDUCING DEVICES FOR BOWS filed on May 23, 2000, and the content which is incorporated herein by reference.

FIELD AND BACKGROUND OF THE INVENTION

The present invention relates to vibration dampeners, and more specifically to archery bow dampeners for torque and vibration reduction of the bow limbs and various parts of the bow.

As an arrow is released from a bow and immediately afterwards, an extreme vibration is generated in different parts of the bow. The shock is created due to the abrupt return of the limbs and the string of the archery bow to their original positions. This shock robs the arrow of energy and negatively effects the accuracy and speed. In addition, the shock effects the joints of the archer in an adverse way and may loosens components of the bow and/or shorten the life of the bow limbs.

To overcome this problem, dampeners, which were developed for non-archery applications, have been applied to archery bows for absorbing longitudinal vibrations. However, none have overcome adequately the problem of reducing torsional vibration of the limbs as well as the longitudinal vibrations. Also, the vibration mode is complicated; bow limbs tend to oscillate independently of each other resulting In a mixed vibrational mode of limbs twisting and bending simultaneously, thereby requiring multiple dampening devices.

One prior art device was designed for baseball bats, tennis rackets and other impact implements, which encompass a 360-degree arc and are normal to the longitudinal axis of the accessory. See U.S. Pat. No. 5,362,046. Although this device dampens vibrations fairly well, it is not as effective as a device designed to work in the same plane as the limbs of the bow.

It is an object of the present invention to dampen and absorb shocks and vibrations in limbs and other parts of the bow.

It is a further object of the present invention to control the torque of the limbs.

SUMMARY OF THE INVENTION

The objects set forth above as well as further and other objects and advantages of the present invention are achieved by a dampening system that dampens the vibrations generated by the limbs of the bow. The dampener maybe applied in various locations of the bow (e.g. limbs, riser, accessories, etc.), where vibration is a present The general shape of this device is a wedge or combination of wedges made of a single elastomeric material or a combination of elastomers. The device takes the form, in some preferred embodiments, of a base portion affixed to a limb and a portion suspended over the limb. There are many variations of the volume proportions of the area of the base portion that comes in direct contact with the limb end the proportion that is suspended above the limb. Also, where multiple elastomers are used the combination of different Shore hardness of the elastomers can range from 0–60. The preferred form of such a wedge device is approximately 65 mm long by 15 mm wide and 25 mm high, but dimensions can vary depending on the size and power of the bows and cross bows.

One class of preferred embodiments comprises a one-piece wedge design with the entire length of a bottom plane of the device adhered to the bow via a flexible plastic plate permanently attached to the dampener. The plate has an adhesive layer for securely attaching the device to the bow. The device can be attached to the bow by other suitable means of adhesion or fastening. Other classes of preferred embodiments include a two part construction with an inner wedge inserted into a notch of the device. Other variations within the scope of the invention include diverse uses of materials (e.g. metals and plastics) and diverse amounts of protrusion of the inner wedge.

For a better understanding of the present invention, together with other and further objects thereof, reference is made to the accompanying drawings and detailed description and its scope will be pointed out in the appended claims.

DETAILED DESCRIPTION OF THE PREFERRED EMBODIMENTS

Figure 1:
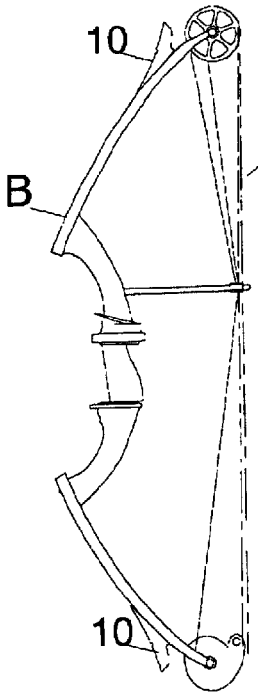
FIGS. 1 and 2 are side and front views of a bow showing four emplaced wedge-form dampeners.
Figure 2:
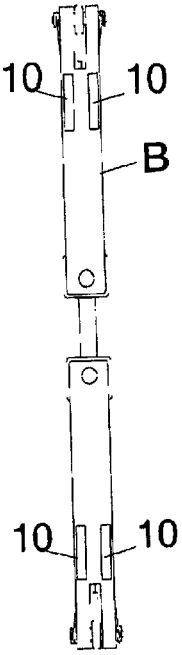
Figure 3:
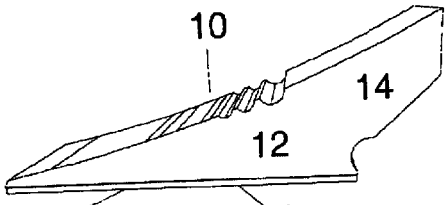
FIG. 3 is an isometric pictorial view of a preferred embodiment of the dampener and FIGS. 4 and 5 are end and top views thereof.
Figure 4:
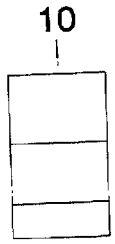
Figure 5:
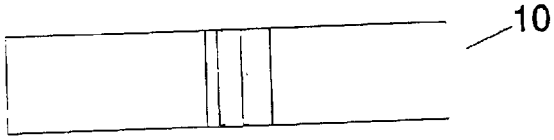

FIGS. 1 and 2 illustrate a bow with the device (10) of a preferred embodiment of the invention placed symmetrically on the bow. The dampener is shown further in FIGS. 3–6 to have a base section 12 and an extending substantially triangular extension (wedge end) 14. A plate 13 (FIG. 3) is provided on the base portion connected thereto and having adhesive face A (which can be overlaid with a protective liner (not shown)—for storage and transport). Although, this is the preferred method of attachment it is not the only method. The device can be attached to the bow by other suitable means of adhesion or fastening.

Figure 6:
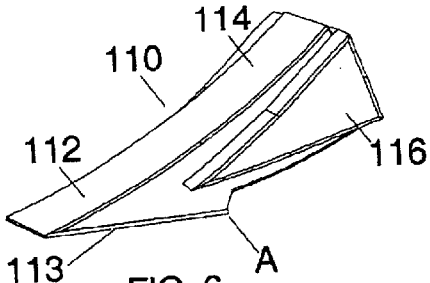
FIGS. 6 and 7 are isometric views of alternative preferred embodiments of the dampener with two-piece construction.

FIG. 6 shows another form 110 of the device with an insert 116. In a wedge portion 114. The device consists of two parts mad, of elastomer with different durometers. A base 113 of a shortened length of the device adheres to the bow. The other half part of base 112 and its 114 extension including insert 116 is suspended above the limb. The device has a flexible plastic plate 113 permanently attached to it. On the bottom of the plate 113 adhesive tape A for securely attaching the device to the bow.

Figure 7:
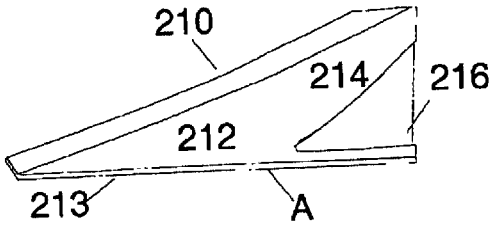

FIG. 7 shows another embodiment 210 of the device with an insert 216 made of elastomers of different durometers. The entire length of the bottom of the device plate 213 of the hose 212 includes an adhesive A for affixing the device to the bow.

In the various embodiments the devices are attached to various locations on the limbs of the bow. After the arrow is released, the limbs generate intense vibration. By oscillating independently from the limbs, the device speedily and effectively dampens the vibration of the limbs and reduces the noise associated with it.

Figure 8:
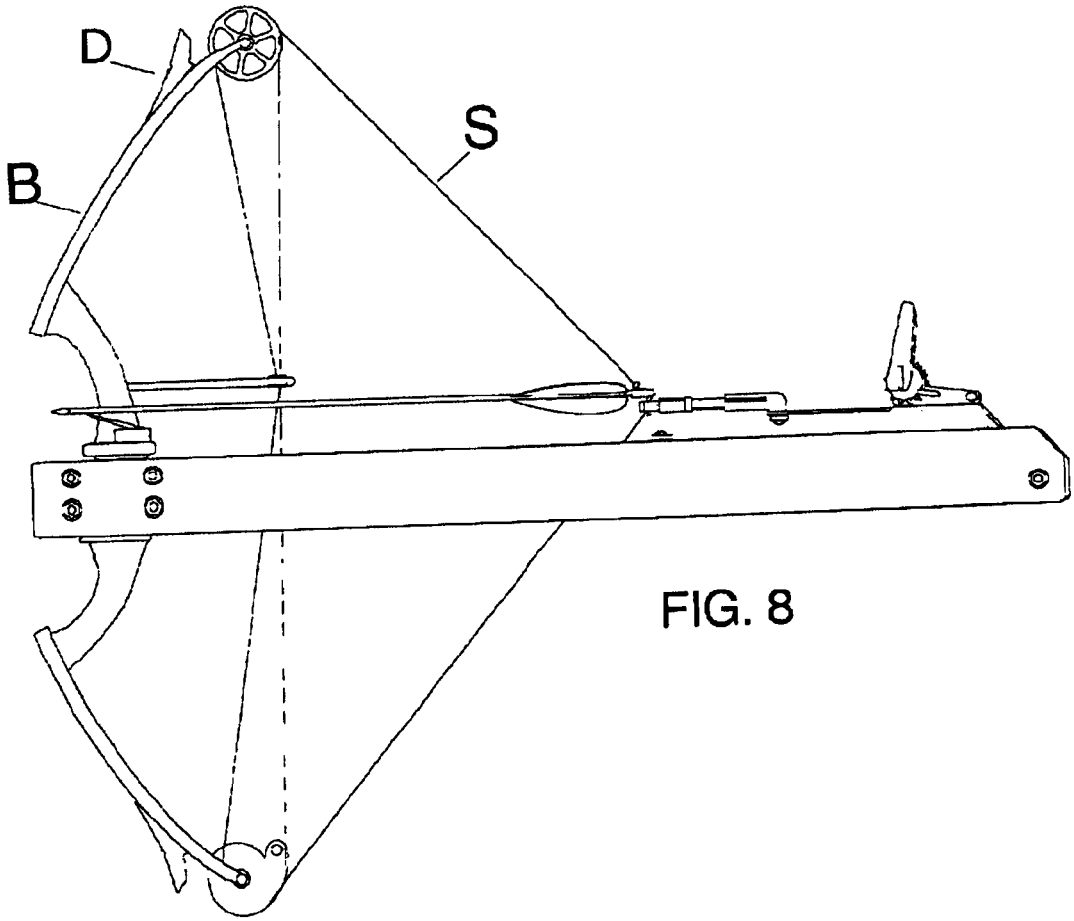
FIG. 8 is a perspective view of a bow test rig having a bow position thereon.

FIG. 8 shows a test rig used in MIT's Harold Edgerton laboratory to evaluate the dampener of the invention and U.S. Pat. No. 5,362,046 of Nov. 8, 1994 (S. C. Sims). Amplitude and frequency of oscillation (and acceleration) of the bow were measured without dampeners and with respective dampeners attached Those tests were supplemented by stroboscopic photography. Similar tests were made with a hand held bow. Both forms of dampeners significantly reduced vibration of the bow. Also the present invention had noticeable improvement over the dampener of the '046 patent in reduction of amplitude of the acceleration waveform for bow vibration, particularly in a 40–60 millisecond time range (after string release).

The dampener devices can be placed at various bow locations for good effect (preferrably near outer extremeties of the bow, as shown. But placement on the bow riser and other locations can also be made beneficially. A wide range of adhesives can be used for affixing each dampener to a bow including super glue, general purpose glue, epoxy resin, acrylic resin, urethane, resin, cement, natural gums and resins, mucilage, starch and starch derivatives, rubber adhesives, cellulose derivatives, or combinations thereof.

In addition to or in lieu of adhesive fastening, mechanical fasteners can be used including screws, nails, clips, channels, bands, ties and the like.

Although the invention has been described with respect to various embodiments, it should be realized this invention is also capable of a wide variety of further and other embodiments within the spirit and scope of the appended claims.

What is claimed is:

1. An archery bow dampening device comprising:

a base portion and substantially wedge-like extension portion suspended from the base portion, the base portion and the wedge-like extension portion being made of an elastomer;

a contact area positioned on the base portion and attachable along the contact area to an archery bow;

wherein the wedge-like extension portion is configured to be free of contact with the archery bow in directions which are generally normal to the longitudinal axis of the archery bow reciprocating in the plane of the bow.

2. The device as recited in claim 1, wherein said device further comprises a notch and an insert both made of elastomers, said insert being disposed within the notch, said insert being made of one or more elastomers of lower durometer properties than the elastomer of said base portion, whereby said insert is compressed in the notch.

3. The device as recited in claim 2, wherein the Shore hardness of the elastomer from which said device is fabricated is in the range of 20 to 60.

4. The device as recited in claim 3, wherein the Shore hardness of the elastomer from which said insert is fabricated is in the range of 0 to 20.

5. The device as recited in claim 1 wherein the Shore hardness of the elastomer from which said device is fabricated is in the range of 0 to 20.

6. The device as recited in claim 1 wherein said device comprises fastening means for attaching said device to the archery bow.

7. The device as recited in claim 6, wherein said fastening means comprises an adhesive strip, having a coating of pressure-sensitive adhesive, fixedly attached to said contact area of the device.

8. The device as recited in claim 6, wherein said adhesive substance is selected from the group consisting of super glue, general purpose glue, epoxy resin, acrylic resin, urethane resin, cement, natural gums and resins, mucilage, starch and starch derivatives, rubber adhesives, cellulose derivatives, and combinations thereof.

9. The device as recited in claim 6, wherein said fastening means comprises a mechanical fastener.

10. The device as recited in claim 1, wherein said device is constructed and arranged for affixing to at least one of the limbs of the archery bow.

11. An archery bow dampening device, comprising:

a base portion and substantially wedge-like extension portion suspended from the base portion, the base portion and the wedge-like extension portion being made of an elastomer;

a contact area positioned on the base portion and attachable along the contact area to an archery bow;

wherein the wedge-like extension portion is configured to be free of contact with the archery bow in directions which are generally normal to the longitudinal axis of the archery bow reciprocating in the plane of the bow;

a notch formed in the device;

an insert disposed within the notch, and made of one or more elastomers of lower durometer properties than the elastomer of the base portion, the insert being compressed in the notch.

12. The device as recited in claim 11, wherein the Shore hardness of the elastomer from which said device is fabricated is in the range of 20 to 60.

13. The device as recited in claim 12, wherein the Shore hardness of the elastomer from which said insert is fabricated is in the range of 0 to 20.

14. The device as recited in claim 11 wherein the Shore hardness of the elastomer from which said device is fabricated is in the range of 0 to 20.

15. The device as recited in claim 11 wherein said device comprises fastening means for attaching said device to the archery bow.

16. The device as recited in claim 15, wherein said fastening means comprises an adhesive strip, having a coating of pressure-sensitive adhesive, fixedly attached to said contact area of the device.

17. The device as recited in claim 15, wherein said adhesive substance is selected from the group consisting of super glue, general purpose glue, epoxy resin, acrylic resin, urethane resin, cement, natural gums and resins, mucilage, starch and starch derivatives, rubber adhesives, cellulose derivatives, and combinations thereof.

18. The device recited in claim 15 wherein said fastening means comprising a mechanical fastener selected from the list consisting of:

screws;

nails;

clips;

channels;

bands; and ties.

19. The device as recited in claim 11, wherein said device is constructed and arranged for affixing to at least one of the limbs of the archery bow.

20. A dampening device for an archery bow, comprising:

a wedge portion manufactured from an elastomer, having a base and a substantially triangular extension extending from the base;

an insert locatable within the wedge portion; and a plate secured to the base and configured to affix the wedge portion to an archery bow.

21. The device of claim 20 wherein the insert comprises at least two elastomers of different durometers.

22. The device of claim 20 wherein the plate further comprises an adhesive plate.

23. The device of claim 20 wherein the device may be affixed to the archery bow using at least one material selected from the group consisting of adhesives, epoxy resin, acrylic resin, urethane resin, cement, natural gums, natural resins, mucilage, starch, starch derivatives, rubber adhesives, cellulose derivatives, screws, nails, clips, channels, bands, and ties.

* * * * *